US009865909B2

(12) United States Patent
Chan

(10) Patent No.: US 9,865,909 B2
(45) Date of Patent: Jan. 9, 2018

(54) CAVITY RESONATOR WITH THERMAL COMPENSATION

(71) Applicant: Northrop Grumman Systems Corporation, Falls Church, VA (US)

(72) Inventor: Edward Chan, Torrance, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 154 days.

(21) Appl. No.: 15/045,356

(22) Filed: Feb. 17, 2016

(65) Prior Publication Data

US 2017/0237143 A1 Aug. 17, 2017

(51) Int. Cl.
*H01P 1/208* (2006.01)
*H01P 1/30* (2006.01)
*H01P 7/06* (2006.01)

(52) U.S. Cl.
CPC ..... *H01P 1/208* (2013.01); *H01P 1/30* (2013.01); *H01P 7/06* (2013.01)

(58) Field of Classification Search
CPC .... H01P 1/30; H01P 7/06; H01P 1/207; H01P 1/208
USPC ..... 333/208, 209, 229
See application file for complete search history.

(56) References Cited

U.S. PATENT DOCUMENTS 3,680,012 A * 7/1972 Moreau ..... H01P 1/208 333/209
4,677,403 A * 6/1987 Kich ..... H01P 1/2082 333/209
5,304,968 A 4/1994 Ohtonen et al.
5,905,419 A 5/1999 Lukkarila
6,049,155 A * 4/2000 Graebner ..... H03H 9/145 310/313 A
6,149,742 A * 11/2000 Carpenter ..... C22F 1/006 148/563
8,408,358 B1 4/2013 Hermiller et al.
2006/0132264 A1 6/2006 Hoft et al.

FOREIGN PATENT DOCUMENTS

EP 1760824 3/2007

OTHER PUBLICATIONS

Williams, K. A. et al; Dynamic modelling of a shape memory alloy adaptive tuned vibration absorber; Journal of Sound and Vibration 280, No. 1 (2005): 211-234.

* cited by examiner

*Primary Examiner* — Rakesh Patel
(74) *Attorney, Agent, or Firm* — Patti & Malvone Law Group, LLC

(57) ABSTRACT

An exemplary cavity resonator has a resonant frequency and includes a conductive body containing a cavity and a plate attached to the body enclosing the cavity. The position of a conductive tuning mechanism that protrudes into the cavity affects the tuning of the resonant frequency of the cavity resonator. A portion of the enclosed cavity is made of a shape memory alloy (SMA) material that has been trained to have a coefficient of thermal expansion that results in dimensional changes of the portion as the temperature varies so that the dimensional changes produce changes in the resonant frequency that counteract the combined change in the resonant frequency due to dimensional changes with temperature associated with the other portions of the enclosed cavity made of materials other than SMA material. This results in a stable resonant frequency versus temperature characteristic.

11 Claims, 3 Drawing Sheets

CAVITY RESONATOR WITH THERMAL COMPENSATION

BACKGROUND

This invention relates to a cavity resonator and more specifically relates to changes to the resonant frequency of the resonator and hence changes to the frequency characteristics of the resonator due to temperature variations.

A plurality of coupled cavity resonators can be utilized to form an RF filter with a designed magnitude versus frequency characteristic. Such a filter may be formed from a metal body with separated hollow cavities defining individual resonators enclosed by a cover plate. A tuning mechanism such as metal screws with an adjustable length protruding into the hollow cavities can be utilized to fine tune each resonator to a desired frequency. The physical dimensions of the hollow cavities and the position and length of the tuning screw determines the resonant frequency of the resonator. As the materials of the resonator expand or contract due to changes in temperature, the resonant frequency of the resonator, and hence the magnitude versus frequency response of the filter, will change since the resonant frequency depends on the physical dimensions of the cavity and the position of the tuning mechanism.

SUMMARY

It is an object of the present invention to provide a cavity resonator in which changes to its resonant frequency due to temperature variations are minimized.

An exemplary cavity resonator has a resonant frequency and includes a conductive body containing a cavity and a plate attached to the body enclosing the cavity. The position of a conductive tuning mechanism that protrudes into the cavity affects the tuning of the resonant frequency of the cavity resonator. A portion of the enclosed cavity is made of a shape memory alloy (SMA) material that has been trained to have a coefficient of thermal expansion that results in dimensional changes of the portion as the temperature varies so that the dimensional changes produce changes in the resonant frequency that counteract the combined change in the resonant frequency due to dimensional changes with temperature associated with the other portions of the enclosed cavity made of materials other than SMA material. This results in a stable resonant frequency versus temperature characteristic.

An exemplary method provides temperature compensation of the resonant frequency of a cavity resonator. A portion of an enclosed cavity of the cavity resonator is made of a shape memory alloy (SMA) material. The SMA material is trained to have a predetermined coefficient of thermal expansion (CTE) that results in dimensional changes of the portion as the temperature varies so that the dimensional changes produce changes in the resonant frequency that counteract the combined change in the resonant frequency due to dimensional changes with temperature associated with other portions of the enclosed cavity made of materials other than SMA material.

DESCRIPTION OF THE DRAWINGS

Features of exemplary implementations of the invention will become apparent from the description, the claims, and the accompanying drawings in which:

DETAILED DESCRIPTION

Figure 1:
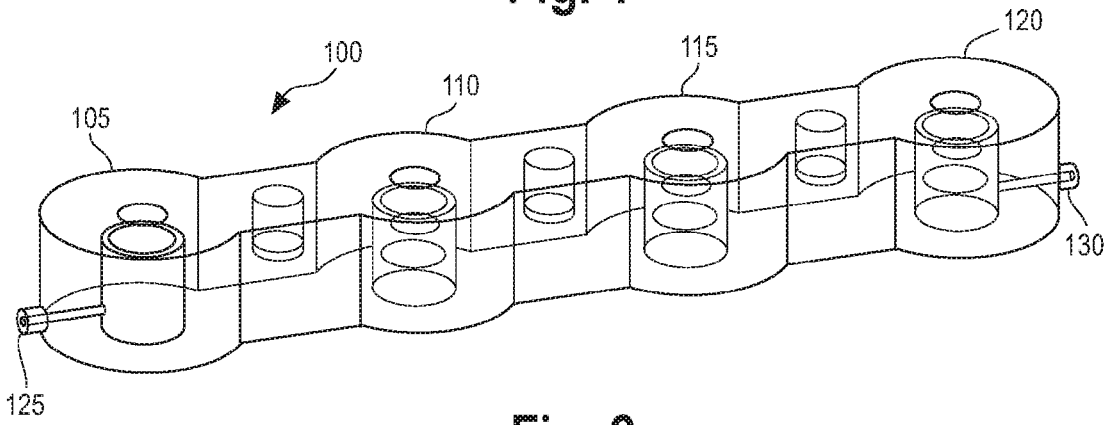
FIG. 1 shows an RF filter with 4 cavity resonators.

FIG. 1 shows a four stage filter 100 consisting of cavity resonators 105, 110, 115 and 120 with an input signal coupled at port 125 and a resulting filtered output signal at port 130. Each cavity resonator is coupled to the next adjacent cavity resonator with the signal propagating left to right in filter 100.

Figure 2:
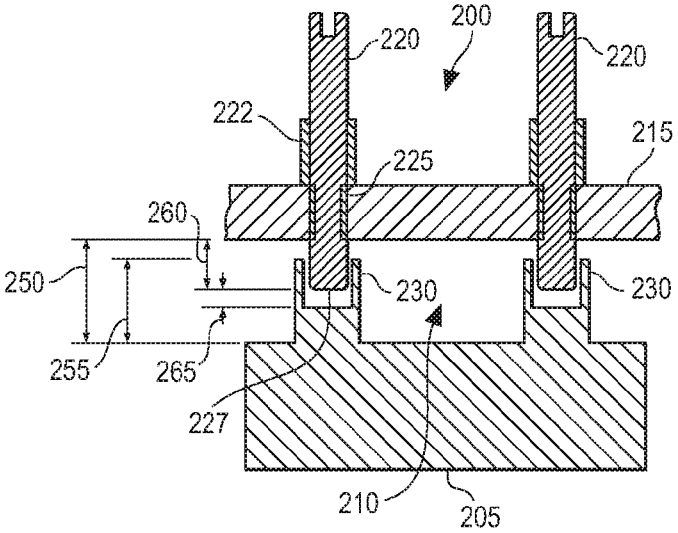
Fig. 2 PRIOR ART
FIG. 2 shows a cross-section of an exemplary cavity resonator in accordance with the prior art.

FIG. 2 shows a cross-section of an exemplary prior art cavity resonator 200 having a body 205 dimensioned to form a cavity 210 in conjunction with a cover plate 215. The body 205 and the cover plate 215 are made of a conductive metal such as aluminum. A mechanical tuning mechanism, e.g. tuning screws, 220 may be made of a silver alloy. Tuning screws 220 have threads that engage corresponding threads in hole 225 of the cover plate 215 permitting the length of the screw that extends below the cover plate 215 to be adjusted. A threaded sleeve 222 engages the tuning screw 220 and acts as a stop in conjunction with the top of cover 215 to secure the tuning screw 220 in a fixed position when the tuning is complete. The basic resonant frequency of the cavity resonator is determined by the volume of cavity 210. However, the position of the end 227 of tuning screw 225 relative to the corresponding resonator rods 230 provides a tuning adjustment allowing the basic resonant frequency to be adjusted. The cavity resonator 200 as represented in FIG. 1 is circular and is symmetrical about its axis.

Figure 3:
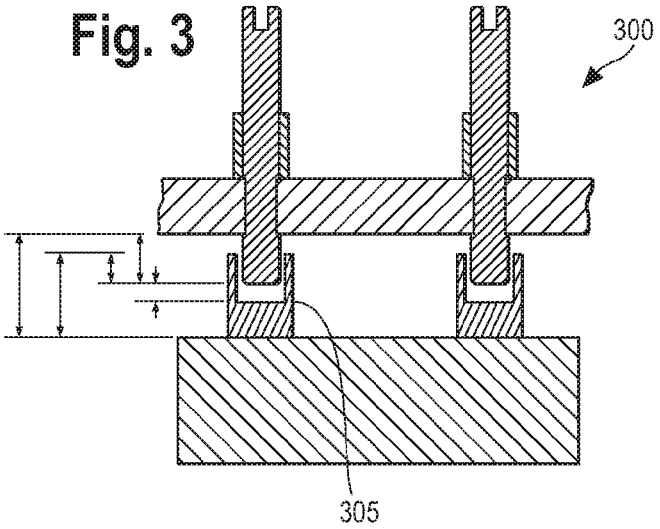
FIG. 3 shows a cross-section of an exemplary cavity resonator in accordance with an embodiment of the present invention.

FIG. 3 shows a cross-section of an exemplary cavity resonator 300 in accordance with an embodiment of the present invention. Except as described below, the same elements and dimensions as previously described with regard to FIG. 2 apply to cavity resonator 300 and hence the same reference numerals are not repeated in FIG. 3. The resonator rods 305, unlike resonator rods 230 which were constructed as part of the aluminum body 205, are formed from a shape memory alloy (SMA) material attached to the metal body. The SMA material has been trained/conditioned to provide a desired coefficient of thermal expansion (CTE) over the temperature range of interest, e.g. −25° C. to +75° C.

With regard to resonator 200, as temperature increases:

(1) dimension 250 increases tending to cause the center frequency to shift higher;

(2) dimension 255 increases tending to cause the center frequency to shift lower;

(3) dimension 260 increases tending to cause the center frequency to shift lower.

These dimensional changes are due to the coefficient of thermal expansion for the respective materials. The combined effect of these dimensional changes results in the center frequency of the passband shifting down in frequency as temperature increases. These effects are for the aluminum and silver alloy materials used for cavity resonator 200. The same materials and dimensions as described for resonator 200 are utilized for cavity resonator 300 except for the material used for the resonator rods 305. The cavity resonator 300, like cavity resonator 200, is circular and is symmetrical about its axis.

Figure 4:
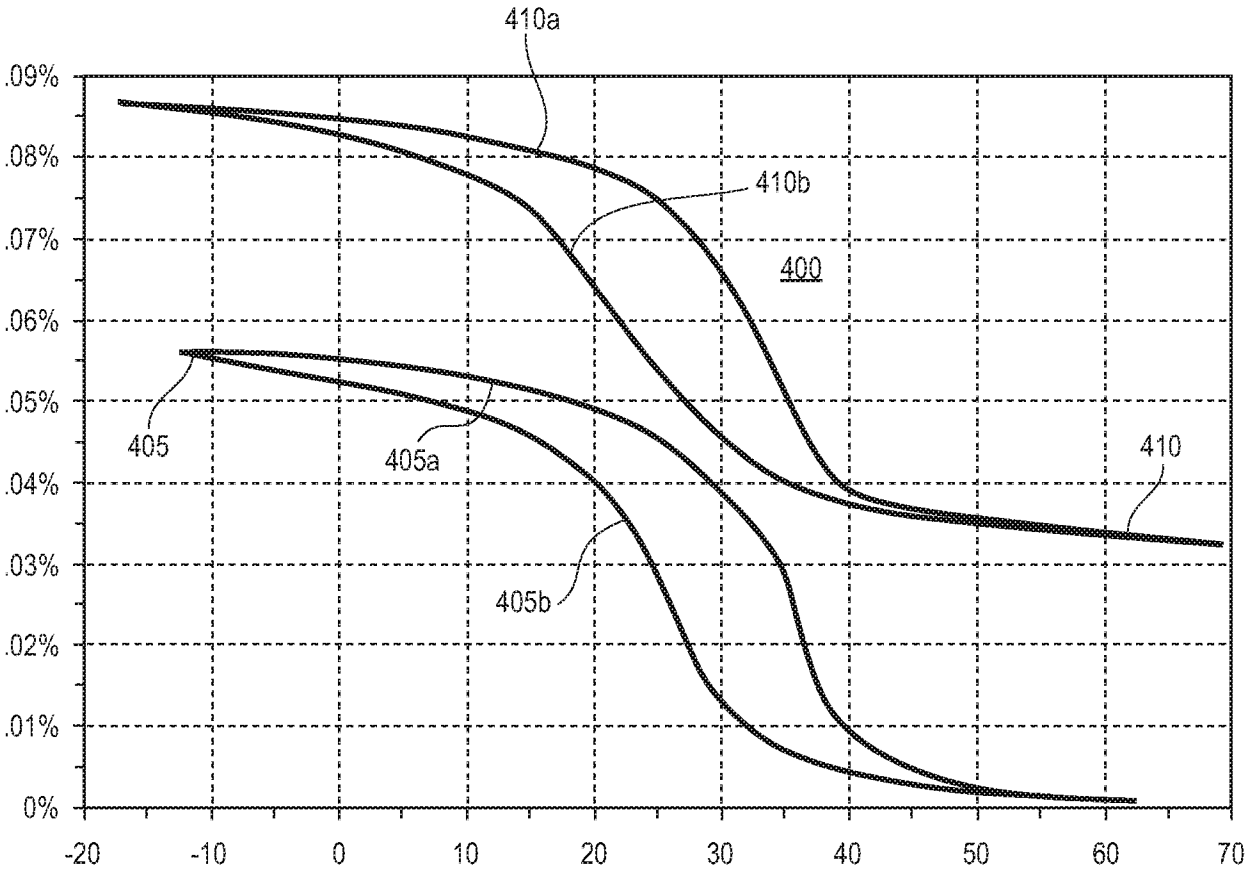
FIG. 4 is a graph illustrating the exemplary training of a shape memory alloy material to exhibit a desired physical dimension versus temperature characteristic.

FIG. 4 is a graph 400 generally illustrating the strain versus temperature characteristics of a shape memory alloy material during training steps. In accordance with the embodiment 300 of the present invention a solution for minimizing frequency versus temperature changes for the cavity resonator utilizes a two-way SMA material as part of the cavity resonator. The SMA material is trained to provide a CTE that is used to counteract/balance the naturally occurring CTE of the other materials of the cavity resonator so that resonant frequency variations with temperature are minimized. In graph 400, curve 405 with hysteresis illustrates the strain versus temperature characteristic during a first cycle of training. The curve 405*a* represents strain as the temperature increases from −15 C to 70 C and curve 405*b* represents strain as the temperature decreases from 70 C to −15 C. The curve 410 illustrates the strain versus temperature characteristic during the 80th cycle of training representing the last training cycle having a stable characteristic as shown. The curve 410*a* represents strain as the temperature increases from −15 C to 70 C and curve 410*b* represents strain as the temperature decreases from 70 C to −15 C. The SMA material curves and training of FIG. 4 is meant to generally illustrate SMA material characteristics and does not depict specific curves/characteristics of the resonator rod 305.

The resonator rods made of SMA material are trained to exhibit the desired geometry changes as temperature changes. The following method can be used for training a resonator rod to expand/contract a designed amount as temperature rises.

1. An SMA material should be chosen so that the austensite and martensite phase change temperature will be within the maximum and minimum temperatures that the filter cavity will experience during operation.

2. The SMA resonator rod is subjected to the maximum temperature in a stress-free condition.

3. The SMA resonator rod is then subjected to the minimum temperature and then put under a tensile/compressive load, e.g. an amount of constant stress (megapascals), such that the measured strain equals the desired contraction/expansion of the resonator rod when the temperatures go from cold to hot.

4. Continuing to maintain the constant tensile/compressive load, the SMA resonator rod is subjected to temperature cycles of minimum and maximum. This process continues until the hysteresis shape of the strain versus temperature curve stabilizes, i.e. the curve does not substantially shift with more thermal cycles.

5. The SMA resonator rod has now been trained and is attached to the body of the cavity resonator and will expand or contract to the trained dimensions.

The amount of tensile/compressive load to use to achieve the desired amount of dimensional change can be determined in different ways. A person can use a tensile machine that measures strain or dimensional change. The tensile load is increased until the measurement reads the desired dimensional change. Alternatively, Young's modulus of the SMA material can be looked up, where Young's modulus=stress÷strain. Dimensional change can be expressed in terms of strain. Dimensional change=strain*length of resonator. The load can be expressed in terms of stress. Load=stress*cross sectional area of resonator rod. Finally, the required load=Young's Modulus*cross sectional area of resonator rod*length of resonator÷dimensional change.

A filter 100 utilizing four resonant cavities was modeled utilizing a high frequency structural simulator. Each of the four resonant cavities 200 were as shown in FIG. 2. The following are the dimensions of resonant cavities 200 at −25° C.: dimension 250=0.15 inches; dimension 255=0.12 inches; dimension 260=0.06 inches; dimension 265=0.04 inches. The housing, resonator rods and cover were aluminum; the tuning screw was made of coin silver alloy.

Figure 5:
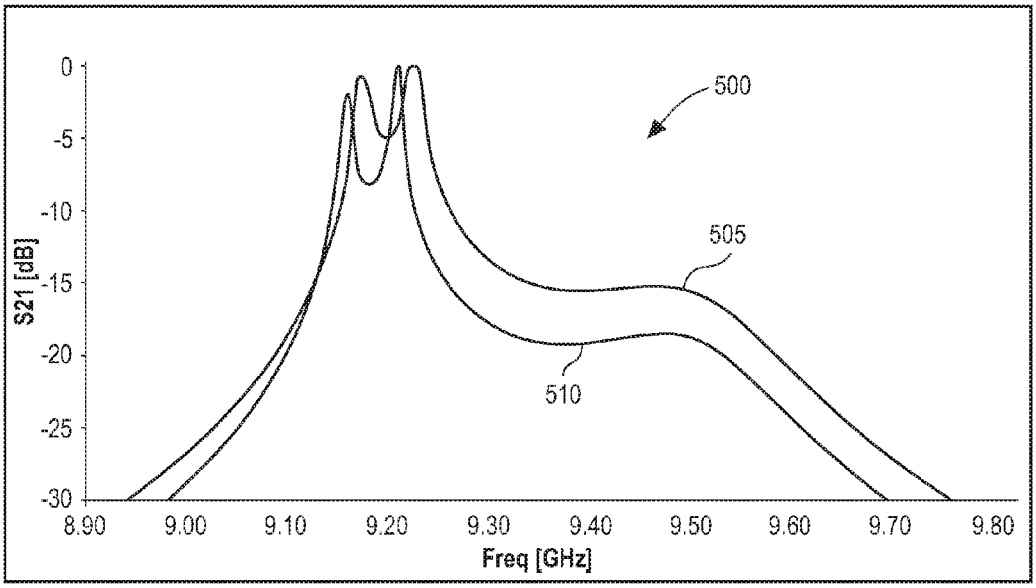
FIG. 5 is a graph illustrating the performance of an exemplary filter with 4 resonant cavities in accordance with the prior art showing changes in performance at different temperatures.

FIG. 5 shows the frequency characteristic for the modeled filter 100 and how it changes at the minimum and maximum temperatures. Graph 500 has a y-axis of insertion loss of the filter in decibels and an x-axis of frequency shown in gigahertz. Curve 505 shows the loss versus frequency response at −25° C. Curve 510 shows the loss versus frequency response at +75° C. Comparing the two curves at −30 DB attenuation, curve 510 is narrower by approximately 120 MHz as compared to the curve 505. The minimum insertion loss for curve 510 has shifted down in frequency compared with the minimum insertion loss for curve 505. The intended center frequency of the bandpass has an overall shift downward in frequency from curve 505 to curve 510 as shown.

Figure 6:
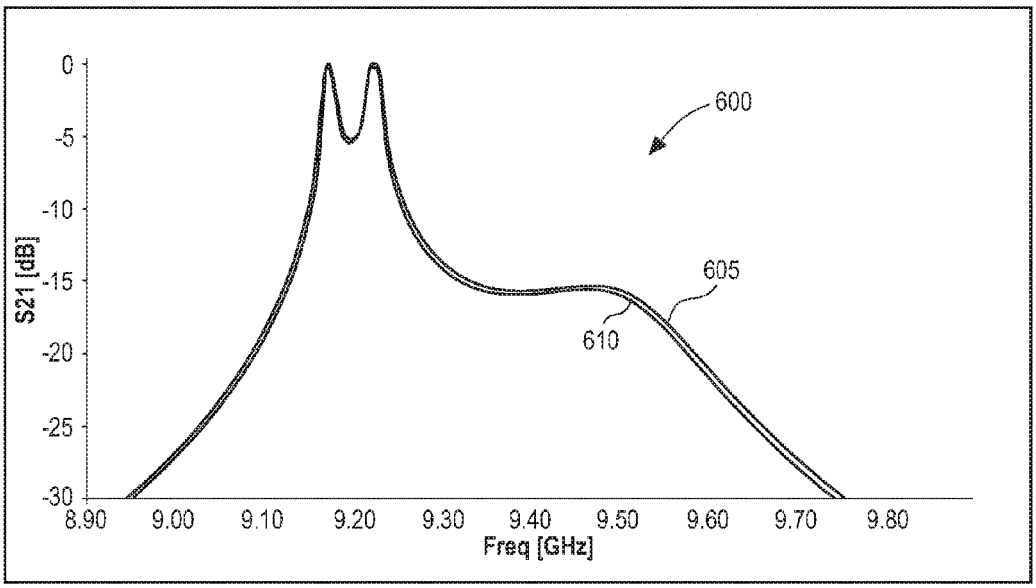
FIG. 6 is a graph illustrating the performance of an exemplary filter with 4 resonant cavities in accordance with an embodiment of the present invention having improved frequency versus temperature performance.

FIG. 6 shows a graph 600 illustrating that the stabilized filter transfer characteristic versus temperature results from corresponding stabilized resonant frequency versus temperature performance of each of the four cavity resonators 300 that make up the exemplary filter. As shown, only minimal changes in performance is present over the different temperatures. A "stabilized" transfer characteristic of the filter or "stabilized" resonant frequency of the cavity resonator means that the transfer characteristic/resonant frequency of the temperature compensated filter/resonant cavity as described herein has substantially less, e.g. 50% less, variation than would occur for filters/resonant cavities without temperature compensation. The resonant cavities 300 have the same dimensions described above for resonant cavity 200 and are constructed of the same materials except for resonator rods 305 made of SMA material. This SMA material was trained to have a CTE of about 10 ppm/C as contrasted with a CTE of 23 ppm/C of resonator rods 230 made of aluminum. Curve 605 shows the frequency characteristic at −25° C.; curve 610 shows the frequency characteristic at +75° C. As demonstrated by graph 600, there is almost no frequency shift of the passband, i.e. 6 dB crossovers. Comparing the two curves 605 and 610 at −30 dB attenuation, curve 610 is narrower by approximately 15 MHz as compared to the curve 605. The frequency narrowing of 15 MHz at −30 dB associated with resonators 300 is an 8 to 1 improvement over the frequency narrowing of 120 MHz associated with resonators 200.

The exemplary resonator rod 305 associated with the cavity resonator 300 and the filter having the characteristics associated with graph 600 is described. The SMA material selected was nickel titanium also known as Nitinol. This material was selected since it had phase change temperatures that were within the −25° C. to +75° C. temperature range. This material has phase change temperatures: martensite finish temperature of 10 to 20 C; austensite finish temperature of 30 to 50 C. The resonator rod 305 starts with the same dimension (0.12 inches long) at −25° C. as resonator rod

230. The resonator rod 305 would then be stretched in length to match the length of a material with a CTE of 10 ppm/C at 75° C.

The required CTE of the resonator rod to achieve temperature compensation of the frequency transfer characteristic for the cavity resonator can be determined by computer simulation such as by a high frequency structural simulator. Simulations with different trial CTEs of the SMA resonant rod (and using the known CTEs of the other cavity materials) can be done to empirically determine a range of CTEs that includes the CTE that will provide the desired temperature compensation. Then trial values of CTEs with finer granularity within that range can be evaluated to determine the ideal CTE, e.g. in this embodiment about 10 ppm/C.

The resonator rod is held at the stretched length of 0.12012 inches as it is repeatedly heated and cooled between −25° C. and +75° C. Since 75° C. is above the austensite finish temperature, the resonator will be trained to be at 0.12012 inches at +75° C. Since −25° C. is below the martensite finish temperature, the resonator will revert to 0.12 inches at −25° C. The resonator rod will come closer and closer to having a CTE of 10 ppm/C between −25° C. and +75° C. with more temperature cycling being performed until the SMA material stabilizes. The dimensional change (stretched length) is determined by the formula: dimensional change=CTE*original dimension (at cold temperature extreme)*change in temperature/1000000. In this resonator rod 305 example, dimensional change=10 ppm/C*0.12 inches*100° C. temperature range/1000000=0.00012 or a change from 0.12 inches to 0.12012 inches.

Although exemplary implementations of the invention have been depicted and described in detail herein, it will be apparent to those skilled in the art that various modifications, additions, substitutions, and the like can be made without departing from the spirit of the invention. For example, other parts of the cavity resonator, e.g. the tuning screw, could be made of a SMA material and trained to have an appropriate CTE to offset the other CTEs of materials of the resonator to achieve a more stable frequency characteristic versus temperature. Although the body of the cavity resonator could be constructed of an SMA material, such materials are relatively costly and hence to be cost-effective it will normally be preferable to select an element having a smaller volume to serve as a trained SMA material.

The scope of the invention is defined in the following claims.

The invention claimed is:

1. A cavity resonator having a resonant frequency comprising:

a conductive body containing a cavity;

a conductive plate attached to the body and enclosing the cavity;

a mechanical tuning mechanism that protrudes into the cavity, a position of the tuning mechanism in the cavity affecting a tuning of the resonant frequency of the cavity resonator;

a portion of the enclosed cavity being made of a shape memory alloy (SMA) material that has been trained to have a coefficient of thermal expansion that causes dimensional changes of the portion as a temperature of the cavity resonator varies so that the dimensional changes counteract other dimensional changes due to other parts of the enclosed cavity that are made of materials other than the SMA material to stabilize the resonant frequency of the cavity resonator as the temperature changes, said portion made of the SMA material comprising a resonator rod attached to the body within the enclosed cavity.

2. The cavity resonator of claim 1 wherein the SMA material is nickel titanium.

3. The cavity resonator of claim 1 wherein the mechanical tuning mechanism has an end and the resonator rod is located adjacent the end.

4. A filter for electronic signals, where the filter contains a plurality of coupled resonant cavities and produces a signal transfer characteristic, each resonant cavity comprising:

a conductive body containing a cavity, a conductive plate attached to the body and enclosing the cavity, a mechanical tuning mechanism that protrudes into the cavity, a position of the tuning mechanism in the cavity affecting a tuning of a resonant frequency of the cavity resonator, a portion of the enclosed cavity being made of a shape memory alloy (SMA) material that has been trained to have a coefficient of thermal expansion that causes dimensional changes of the portion as a temperature of the cavity resonator varies so that the dimensional changes counteract other dimensional changes due to other parts of the enclosed cavity that are made of materials other than SMA material to stabilize the resonant frequency of the resonant cavity as the temperature changes;

each of the resonant cavities having a stabilized resonant frequency versus temperature characteristic which produces a stabilization of the signal transfer characteristic during the temperature changes, said portion made of the SMA material comprises a resonator rod attached to the body within the enclosed cavity.

5. The filter of claim 4 wherein the mechanical tuning mechanism has an end and the resonator rod is located adjacent the end.

6. The filter of claim 4 wherein the SMA material is nickel titanium.

7. A method for stabilizing a resonant frequency of a cavity resonator during temperature changes comprising the steps of:

making a portion of an enclosed cavity of the cavity resonator of a shape memory alloy (SMA) material;

training the SMA material to have a predetermined coefficient of thermal expansion (CTE) that causes dimensional changes of the portion as a temperature of the cavity resonator varies so that the dimensional changes counteract other dimensional changes due to other parts of the enclosed cavity that are made of materials other than the SMA material to stabilize the resonant frequency of the cavity resonator as the temperature changes;

the training including:

starting with a first length of the SMA material at one end of a temperature range;

stretching or compressing the first length of the SMA material while at the one end of the temperature range to a second length that equals a length of the SMA material based on the predetermined CTE: (a) when not being stretched or compressed and (b) while at the other end of the temperature range;

maintaining the SMA material at the second length while the SMA material is cycled back and forth between the ends of the temperature range until a strain versus temperature characteristic of the SMA material is stabilized.

8. The method of claim 7 wherein the SMA material is nickel titanium.

9. A method for stabilizing a resonant frequency of a cavity resonator during temperature changes comprising the steps of:

making a portion of an enclosed cavity of the cavity resonator of a shape memory alloy (SMA) material;

training the SMA material to have a predetermined coefficient of thermal expansion (CTE) that causes dimensional changes of the portion as a temperature of the cavity resonator varies so that the dimensional changes counteract other dimensional changes due to other parts of the enclosed cavity that are made of materials other than the SMA material to stabilize the resonant frequency of the cavity resonator as the temperature changes;

forming said portion made of the SMA material into a resonator rod and attaching the resonator rod within the enclosed cavity.

10. The method of claim 9 further comprising attaching said resonator rod adjacent an adjustable tuning mechanism within the enclosed cavity.

11. The method of claim 9 wherein the SMA material is nickel titanium.

* * * * *